United States Patent [19]

Fletcher

[11] Patent Number: 4,892,084

[45] Date of Patent: Jan. 9, 1990

[54] SPACE HEATING APPLIANCE

[75] Inventor: John E. Fletcher, Clifton-on-Teme, England

[73] Assignee: Ambi-Rad Limited, Great Britain

[21] Appl. No.: 268,582

[22] Filed: Nov. 8, 1988

[30] Foreign Application Priority Data

Nov. 10, 1987 [GB] United Kingdom ..... 8726277

[51] Int. Cl.[4] ..... F24C 3/04

[52] U.S. Cl. ..... 126/92 AC; 126/92 R; 126/92 B

[58] Field of Search ..... 126/92 AC, 92 R, 92 B, 126/91 A, 91 R

[56] References Cited

U.S. PATENT DOCUMENTS 3,359,965 12/1967 Milligan ..... 126/92 B
4,507,083 3/1985 Fraioli ..... 126/91 A

FOREIGN PATENT DOCUMENTS 3415058 10/1985 Fed. Rep. of Germany .
790709 11/1955 United Kingdom .
1488479 10/1974 United Kingdom .
1570246 6/1980 United Kingdom .
2179438 7/1985 United Kingdom .
2185100 12/1985 United Kingdom .

OTHER PUBLICATIONS

European Search Report No. EP 88 31 0474.

*Primary Examiner*—Larry Jones
*Attorney, Agent, or Firm*—Learman & McCulloch

[57] ABSTRACT

A radiant plaque heater adapted primarily for overhead use comprises the combination of a combustion panel, an emitter panel, and a combustion product flue wherein combustion products flow across the emitter panel in the direction of the flue and heat the latter to produce radiation which supplements that emitted by the combustion panel.

10 Claims, 1 Drawing Sheet

SPACE HEATING APPLIANCE

This invention relates to space heating appliances of the kind in which a mix of fluid fuel, typically a gas fuel, and air is fed through a combustion panel, typically formed from a ceramic material, to burn at the face thereof so that radiant heat is emitted therefrom. Such appliances are hereinafter referred to as "radiant plaque heaters".

The object of the invention is to provide a radiant plaque heater which is particularly efficient and economical in operation, of simple construction, and reliable, safe and durable in use.

According to the invention there is provided a radiant plaque heater including at least one secondary emitter panel in close proximity to the combustion panel and formed of a heat resistant material, said secondary panel having no provision for feed of gas fuel/air mix thereto but at least some of the products of combustion and/or heated air from the front of the combustion panel flowing across the front face of the secondary panel so that heat therefrom is absorbed by and radiated from the latter panel to supplement the radiation from the combustion panel.

The heater may further incorporate one or more reflector formations for direction of the radiant heat emitted by the panels.

Preferably the panels are so arranged and/or the heater is so mounted in use that the secondary emitter panel or panels receive convective upward flow of combustion products and/or heated air from the combustion panel.

The acting front face area of the secondary panel or panels may be substantially equal to or somewhat greater than the acting front face area of the associated combustion panel or panels.

A variety of materials may be used for forming the secondary panels, preferably a lightweight non-degradable porous, fibrous or cellular material is used, e.g. a ceramic material. Among such materials, suitable for this application, are ceramic fibers, mineral wools, calcium silicate, amorphous silica, insulating firebrick, and/or porous ceramic tile.

BRIEF DESCRIPTION OF THE DRAWINGS

An example of the invention is now more particularly described with reference to the accompanying drawings wherein.

Figure 1:
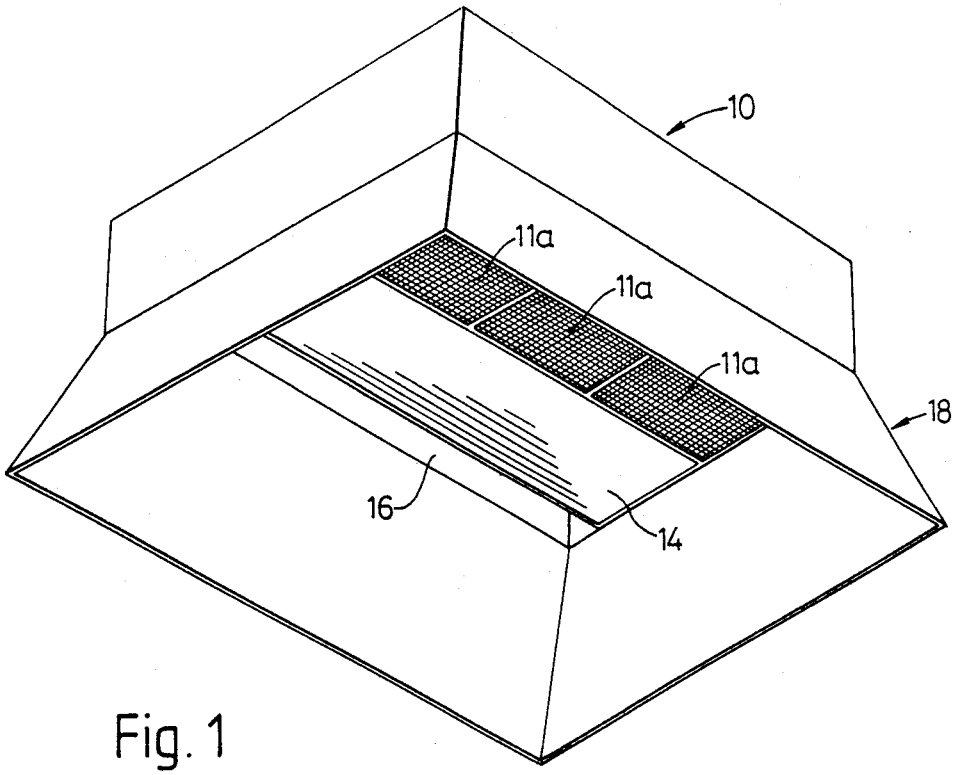
FIG. 1 is a perspective view from below of an overhead radiant plaque heater.
Figure 2:
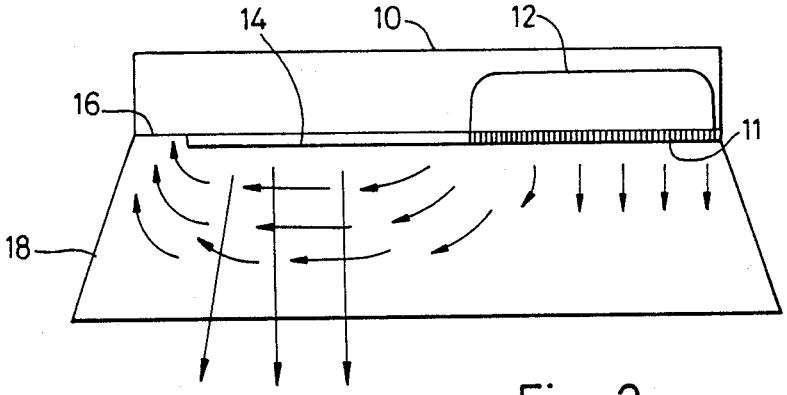
FIG. 2 is a diagrammatic lateral cross-section of the heater.

The heater shown is for mounting overhead e.g. near ceiling level of a room to be heated and comprises a box-like casing which will be supported or suspended by mountings (not shown).

A downwardly facing combustion panel 11, in this example made up of three ceramic tile plaques 11a arranged side by side, occupies somewhat less than one half of the downwardly directed area of casing 10. Panel 11 is operatively fed with a mix of gas fuel and air from a mixing chamber 12 above panel 11 in the known manner, combustion taking place at the exposed downwardly directed front faces of the plaque sections **11*a*** so that radiant heat is emitted therefrom downwardly.

Immediately adjoining combustion panel 11 and occupying almost all the remaining downwardly directed area of casing 10 is a secondary emitter panel 14. The width of this panel is the same as or somewhat greater than the width of panel 11, preferably its exposed downwardly directed front area is at least equal to or up to one and a quarter times the exposed front face area of the combustion panel 11.

Along the side edge of panel 14 remote from the combustion panel is longitudinal gap forming a flue duct 16 extending upwardly within casing 10.

An upwardly tapering rectangular reflector 18 is secured to the lower edges of the side walls of casing 10 so that it surrounds both panels 11 and 14 to assist in directing radiant heat downwardly from the heater.

When mounted in its position of use the substantially co-planar downwardly directed acting faces of the panels 11 and 14 are preferably slightly inclined to the horizontal e.g. by about 5 degrees so that the flue duct 16 is above the level of the side of panel 11 remote therefrom.

As combustion takes place at the exposed face of panel 11 heated air and the hot products of combustion pass across the exposed lower face of the emitter panel 14 in their upward convection flow to reach duct 16 through which they exhaust from the heater. During this flow heat is transferred to and absorbed by panel 14 and is emitted therefrom as radiant heat supplementing the heating effect of the combustion panel 11. In this way substantially increased efficiency is obtained and wastage of heat is substantially reduced.

In this example emitter panel 14 is formed from ceramic fibre though other materials as referred to above may be employed.

What is claimed:

1. A radiant plaque heater comprising a casing, fluid fuel feeding means in said casing, combustion panel means in said casing and in communication with said fuel feeding means, said combustion panel means being adapted to receive fluid fuel therethrough for combustion at the face thereof and emission of radiant heat therefrom, combustion gas flue means in said casing and arranged to receive combustion products from said face of said combustion panel means and exhaust said products from said heater, and secondary emitter panel means in said casing between said combustion panel means and said flue means and presenting an exposed face which is in the path of flow of said products, whereby said exposed face is heated by said products resulting in radiant heat being emitted from said secondary panel means to supplement the radiant heat emitted from said combustion panel means.

2. The radiant plaque heater of claim 1 wherein said secondary emitter panel means is at least approximately in edge-to-edge relation with both said combustion panel means and said flue means, said secondary emitter panel means being resistant to combustion products flow therethrough.

3. The radiant plaque heater of claim 2 wherein said secondary emitter panel means is formed from a material selected from the group consisting of ceramic fibers, ceramic tile, mineral wools, calcium silicates, amorphous silica, and insulating firebrick.

4. The radiant plaque heater of claim 2 wherein said casing includes reflector means cooperating with said panel means in the direction of radiant heat emitted from said panel means.

5. The radiant plaque heater of claim 4 wherein said secondary emitter panel means is arranged in said casing relative to said combustion panel means so that said exposed face receives convective upward flow of said combustion products.

6. The radiant plaque heater of claim 5 wherein said exposed face of said secondary emitter panel means is of an area which is at least equal to the area of said face of said combustion panel means.

7. The radiant plaque heater of claim 1 wherein said casing includes reflector means cooperating with said panel means in the direction of radiant heat emitted from said panel means.

8. The radiant plaque heater of claim 1 wherein said exposed face of said secondary emitter panel means is of an area which is at least equal to the area of said face of said combustion panel means.

9. The radiant plaque heater of claim 8 wherein the area of said exposed face of said secondary emitter panel means is up to as much as one and one quarter greater than the area of said face of said combustion panel means.

10. The radiant plaque heater of claim 1 wherein said secondary emitter panel means is arranged in said casing relative to said combustion panel means so that said exposed face receives convective upward flow of said combustion products.

* * * * *